US006149296A

United States Patent [19]

Asai et al.

[11] Patent Number: 6,149,296

[45] **Date of Patent: *Nov. 21, 2000**

[54] MIXER BLADE ASSEMBLY FOR MEDIUM AND HIGH VISCOSITY LIQUID

[75] Inventors: Mikio Asai; Yoshikazu Katou, both of Saitama Pref., Japan

[73] Assignee: Satake Chemical Equipment Mfg., Ltd., Moriguchi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/193,869

[22] Filed: Nov. 18, 1998

[30] Foreign Application Priority Data

Jan. 30, 1998 [JP] Japan ..... 10-033983

[51] Int. Cl.[7] ..... B01F 7/32

[52] U.S. Cl. ..... 366/313; 366/325.94; 366/329.1

[58] Field of Search ..... 366/65, 67, 262, 366/265, 309, 312, 313, 325.44, 329.1; 422/135, 224–226

[56] References Cited

U.S. PATENT DOCUMENTS

| | | | |
|---|---|---|---|
| 609,480 | 8/1898 | Truex | 366/325.94 |
| 660,251 | 10/1900 | Gray | 366/313 |
| 3,330,538 | 7/1967 | Gabler et al. | 366/325.94 |
| 3,544,081 | 12/1970 | Eckhardt | 366/313 |
| 4,515,483 | 5/1985 | Muller et al. | 366/313 |
| 4,552,461 | 11/1985 | Ott et al. | 366/312 |
| 4,854,720 | 8/1989 | Schold | 366/313 |
| 5,683,178 | 11/1997 | Nakamoto et al. | 366/325.94 |

FOREIGN PATENT DOCUMENTS

| | | | |
|---|---|---|---|
| 62-57636 | 3/1987 | Japan | 366/313 |
| 8-187424 | 7/1996 | Japan . | |
| 2183496 | 6/1987 | United Kingdom | 366/312 |

*Primary Examiner*—Charles E. Cooley
*Attorney, Agent, or Firm*—Oblon, Spivak, McClelland, Maier & Neustadt, P.C.

[57] ABSTRACT

A mixer blade assembly is provided for medium and high viscosity liquid which does not cause the generation of an insufficiently mixed region of a doughnut-shaped configuration within the liquid to be mixed and therefore has excellent mixing performance. The mixer blade assembly for medium and high viscosity liquid includes a rotary shaft including at least two support posts spaced apart from each other; a plurality of plate-shaped inclined blades secured on each of the support posts and spaced apart from each other into multiple stages, the leading edge of each of the blades being displaced rearwardly or forwardly as viewed from the axis of blade rotation from the upper stage to the lower stage; and a bottom impeller secured on the support posts and being located in proximity with the bottom surface of the mixing vessel. The generation of an unmixed region of a doughnut-shaped configuration within the liquid can be eliminated due to generation of a one loop flow pattern within the mixing vessel, and an excellent mixing performance can be achieved for liquids with a wide range of Reynolds number due to suppression of the delamination of flow flowing over the upper surface of each blade.

14 Claims, 10 Drawing Sheets

MIXER BLADE ASSEMBLY FOR MEDIUM AND HIGH VISCOSITY LIQUID

BACKGROUND OF THE INVENTION

1. Field of the Invention

The present invention relates to a mixer blade assembly particularly suitable for mixing medium and high viscosity liquids used in pharmaceutical, food, chemical industries and the like.

2. Description of Background Art

It has been known in the prior art to provide a mixer blade assembly as shown in FIG. 14 in which helical ribbon blades b are secured on a rotary shaft a and a bottom impeller c is secured on the bottom end of the rotary shaft a in order to efficiently mix the medium and high viscosity liquid. However, there is a problem in the prior art mixer blade assembly having helical blades in that an insufficiently mixed region having a doughnut-shaped configuration is generated in the liquid when mixing liquids of a certain range of viscosity and therefore good mixing cannot be achieved.

SUMMARY OF THE INVENTION

It is therefore an object of the present invention to provide a mixer blade assembly which can mix liquids of wide range from low to high viscosity in an excellent manner.

For achieving the object, there is provided according to the present invention a mixer blade assembly for medium and high viscosity liquid comprising a rotary shaft including at least two support posts spaced apart from each other; a plurality of plate-shaped inclined blades secured on each support post spaced apart from each other into multiple stages, the leading edge of each of said blades being displaced rearwardly or forwardly as viewed from the axis of blade rotation from the upper stage to the lower stage; and a bottom impeller secured on the support posts and being located in proximity with the bottom surface of the mixing vessel.

BRIEF DESCRIPTION OF THE DRAWINGS

Preferred embodiments of the present invention will now be described with reference to the accompanied drawings in which.

DESCRIPTION OF THE PREFERRED EMBODIMENTS

A first embodiment of the present invention will now be described with reference to FIG. 1 through FIG. 10.

Figure 1:
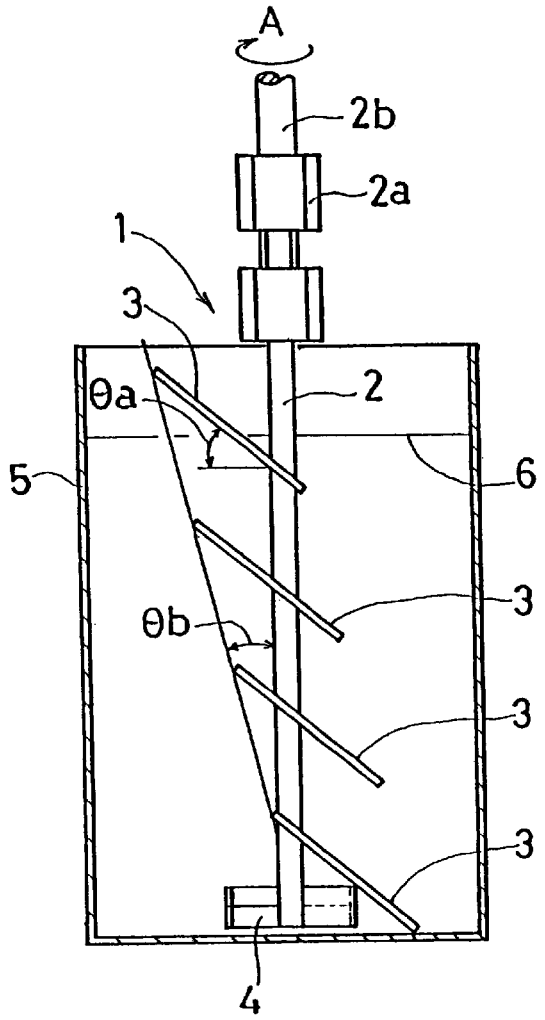
FIG. 1 is a front elevational view ot a mixer blade assembly of a first embodiment of the present invention.
Figure 2:
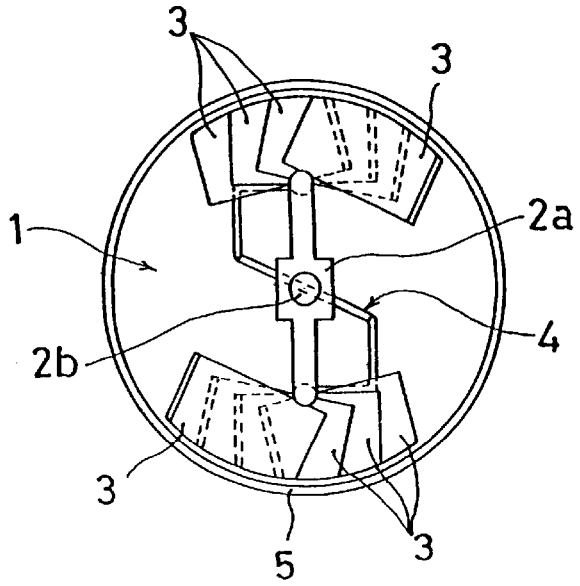
FIG. 2 is a plan view of the mixer blade assembly of FIG. 1.

FIG. 1 is a front elevational view of a mixer blade assembly 1 for medium and high viscosity liquids of a first embodiment of the present invention and FIG. 2 is a plan view thereof.

The mixer blade assembly 1 comprises two blade support posts 2, inclined blades 3 secured on each support post radially outside thereof and spaced apart from each other so as to be divided into multiple stages, a bracket 2*a* for connecting the top ends of the posts 2 and a bottom impeller 4 secured on the support posts.

Figure 3:
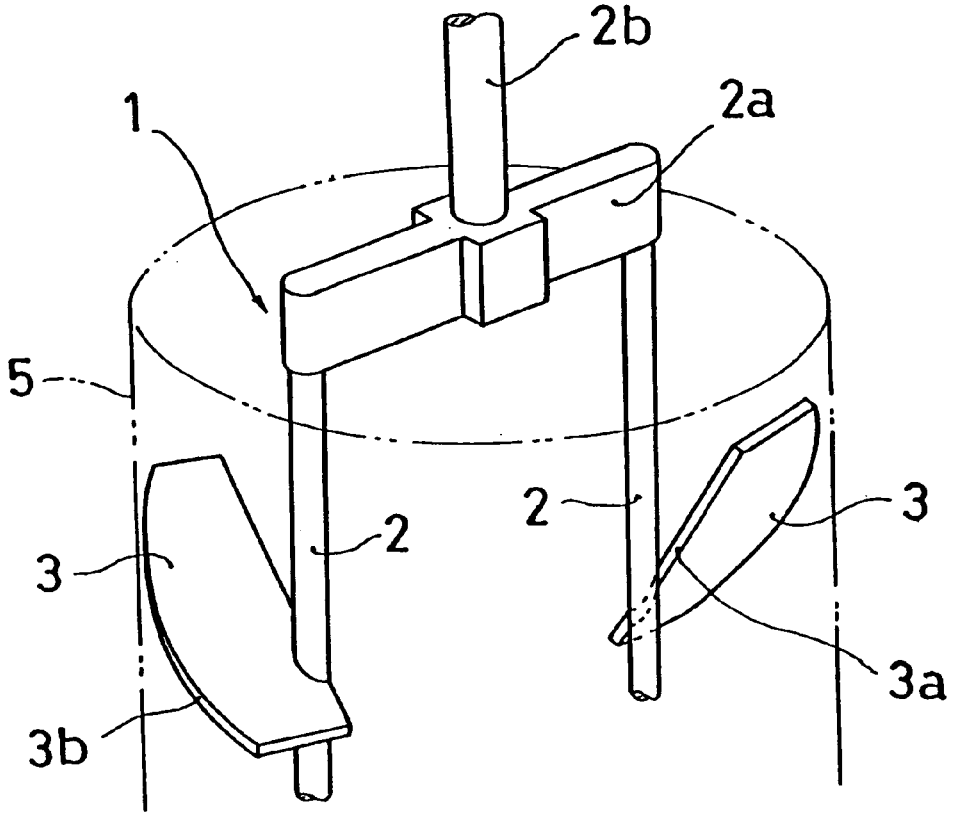
FIG. 3 is a perspective view showing an upper portion of the mixer blade assembly of FIG. 1.

Each blade 3 has a plate-shaped configuration of a constant length and is secured on the post 2 at an inclination angle $\theta_a$ of from 18° to 48°, inclined upwardly as viewed from the axis of blade rotation A. As best shown in FIG. 3, the inner edge 3*a* of each blade 3 is secured on the radial exterior of the posts 2 and the outer edge 3*b* is formed as a circular arc so as to be arranged in proximity with the inner surface of a mixing vessel 5.

A plurality of inclined blades 3 are arranged so as to be spaced apart on the blade support posts 2 so as to form multiple stages of an equal distance and are also arranged so as to be successively displaced rearwardly, as viewed from the axis of blade rotation A, from the upper stage toward the lower stage. The advance angle $\theta_b$ Of the row of the inclined blades is in a range of 3° through 22° and is usually set about at an angle of 15°.

The blade of the upper stage and the blade of the lower stage adjacent to the upper stage are arranged to partially overlap each other as viewed in the vertical direction.

Figure 4:
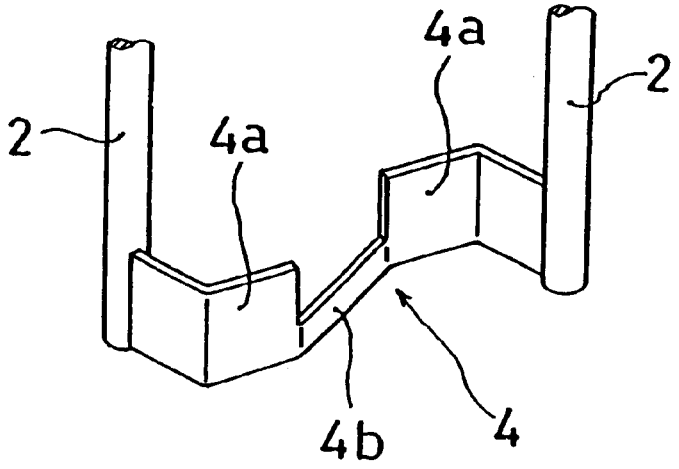
FIG. 4 is a perspective view showing a lower portion of blade support posts.

As shown in FIG. 4, the bottom impeller 4 has a configuration of a substantially folded "S" in a plan view and is secured on the posts 2 at its opposite ends with the bottom edge thereof being in proximity with the bottom surface of the mixing vessel 5. As shown in FIGS. 3 and 4, the support posts 2 are interconnected exclusively at an upper portion thereof to the shaft and at a lower portion thereof by the bottom impeller 4. Shaft 2*a* extends exclusively above the vessel and thus, an unobstructed volume exists in the vessel between the posts 2,2.

The side regions 4*a* of the bottom impeller 4 near the posts 2 are swept back rearward as viewed from the axis of blade rotation A (FIG. 1) and a central region 4*b* between the side regions 4*a* has a height smaller than that of the side regions 4*a*. The bottom edge of the impeller 4 is arranged in proximity with the bottom surface of the mixing vessel 5.

The mixer blade assembly 1 is vertically arranged within the mixing vessel 5 so that the uppermost blade 3 of the row of blades on each post 2 is positioned so as to project from the liquid-level 6 (FIG. 1) during use. The mixer blade assembly 1 is driven by a suitable driving means such as an electric motor via a driving shaft 2*b*.

The operation and effects of the mixer blade assembly 1 of the present invention are described below.

Figure 5:
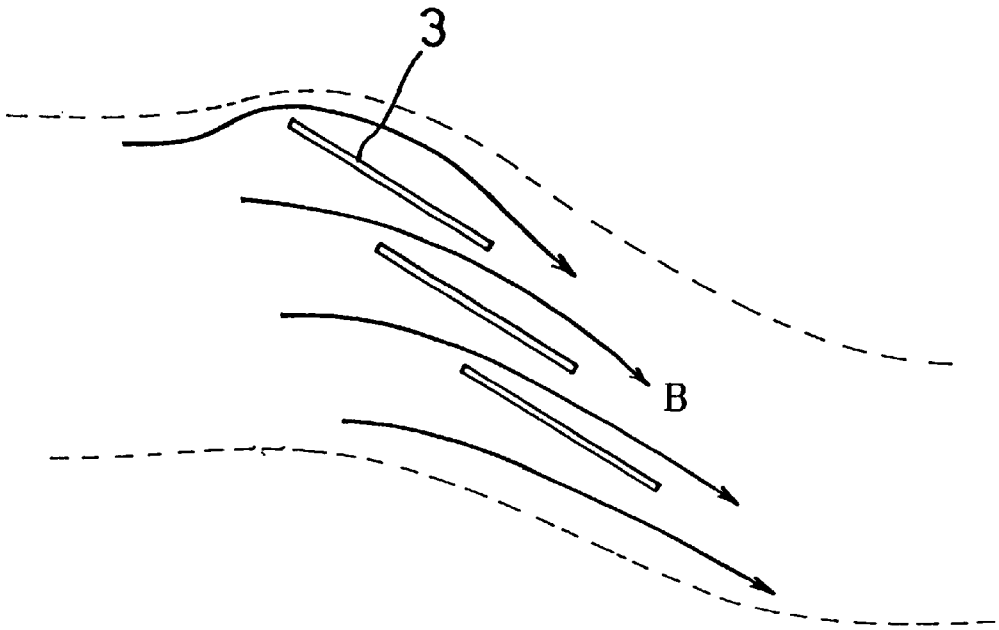
FIG. 5 is an explanatory view showing a flow condition between inclined blades.

With respect to the first embodiment of FIG. 1, the liquid will flow between inclined blades 3 to form a downward oblique liquid flow B as shown in FIG. 5 when the mixer blade assembly 1 is rotated about the axis of rotation A. Since the lowermost blades 3 are arranged to be in proximity with the bottom surface of the mixing vessel 5, the downwardly forced liquid flows toward the center of the mixing vessel 5 along its bottom surface and then is efficiently converted to an upward flow by the bottom impeller 4.

The resistance to flow which would be often caused at the center of the bottom surface of the mixing vessel due to the viscosity of the fluid can be prevented by reducing the height of the central region 4*b* of the bottom impeller 4 so as to be lower than that of the side regions 4*a*.

Thus, a one loop flow pattern is generated within the mixing vessel 5 by the downward oblique flow at the inner periphery of the mixing vessel 5 and the upward flow at the center thereof which therefore efficiently prevents the generation of an insufficiently mixed region having a doughnut-shaped configuration.

The arrangement of the inclined blades in the multiple stage arrangement causes the effect that the upper blade 3 rectifies a flow flowing over the lower blade 3 and thus improves the flow efficiency.

In addition, the successive displacement of each leading edge of the blades 3 rearward as viewed from the axis of blade rotation from the upper stage toward the lower stage causes not only a rectifying effect but also a dragging effect in that the flow from the lower stage drags the flow from the upper stage and thus further improves the mixing efficiency of the mixer blade assembly 1.

Figure 6:
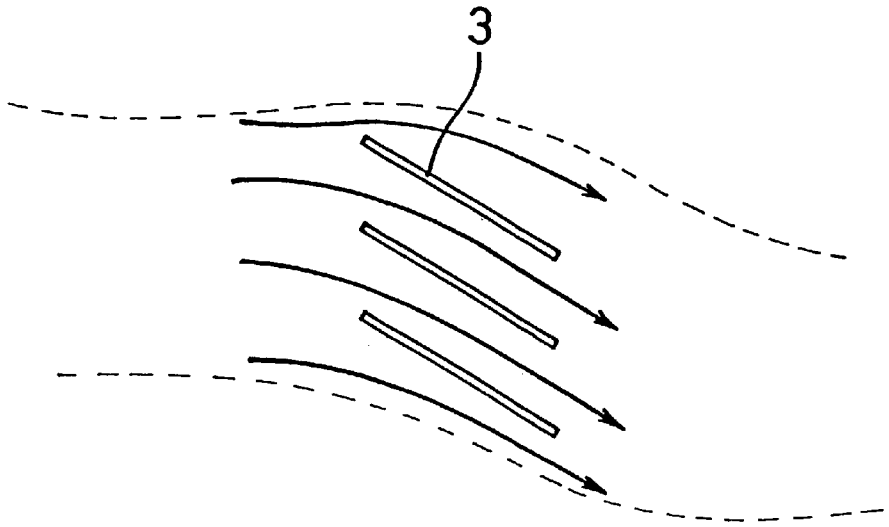
FIG. 6 is an explanatory view showing a flow condition between inclined blades of another type.

The vertically projected area of the blades 3 of multiple stage in the case of a successive displacement arrangement (FIG. 5) is larger than that in the case of a no-displacement arrangement (FIG. 6). This causes the effect of increasing the blade area acting on the liquid.

This in particular causes an effect of producing a high lift mixing blade which does not cause any delamination even if an inclined blade 3 having a large attack angle is applied to a fluid having a high Reynolds number.

Since the uppermost blades 3 are always kept in a condition projected from the liquid level 6, any liquid near the level 6 is forced into a downward oblique flow by the inclined blades 3 and thus does not remain in an unmixed condition. The inventors of the present invention has confirmed these effects from the following experiment.

Prior to carrying out the test of comparing the mixing performance, there was prepared a mixing vessel 5 having an inner diameter of 155 cm and containing therein a liquid with a depth of 155 cm of starch sirup of 10,000 CP, on the one hand, and several kinds of mixer blade assemblies 1 each having a different inclination angle $\theta_a$ for blades 3, each mixer blade assembly 1 having on each post two four-stage of inclined blades 3 each blade having a length of 70 cm and a width of 31 cm. The test was carried out in accordance with the iodine-hypo method. That is, the mixing performance was compared on the basis of the time intervals required for the color (dark brown) of the starch sirup liquid to disappear therefrom, via the steps of first mixing iodine of a reagent concentration 1N into the starch sirup liquid and coloring the starch sirup liquid so as to have a dark brown color, and then pouring, "hypo" (sodium thiosulfate) into the starch sirup liquid at a rate of 1.2 hypo to 1.0 iodine and finally agitating the mixture.

The mixer blade assembly 1 was rotated at a rotational speed of 12 rpm and the agitation Reynolds number during this time period which was about 0.7.

Figure 7:
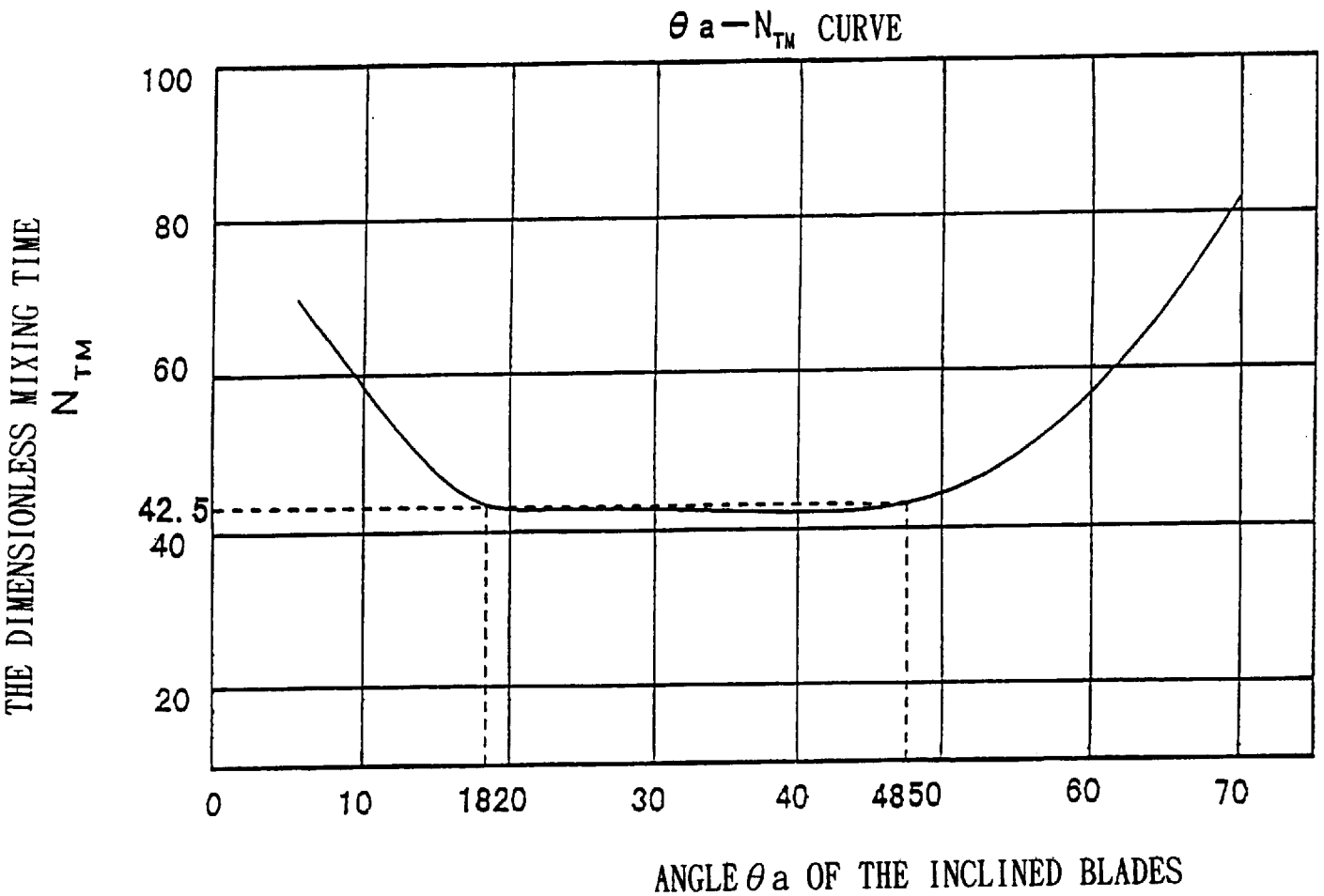
FIG. 7 is a graph showing the relationship between the dimensionless mixing time value $N_{TM}$ and the inclination angle $\theta_a$ of the inclined blades.

The dimensionless mixing time value $N_{TM}$ was calculated by multiplying the mixing time interval "T" thus measured by the rotation speed and the graph of FIG. 7 showing the relation between the inclination angle $\theta_b$ and the dimensionless mixing, time value $N_{TM}$ was obtained.

That is, it can be seen from FIG. 7 that the smaller the valve of dimensionless mixing time $N_{TM}$ is, the higher the mixing efficiency becomes. Also it can be seen from FIG. 7 that the minimum value of $N_{TM}$ is 42.5 and the inclination angle $\theta_a$ at this minimum value is 18° through 48°, and which range of inclination angle is most preferable.

Substantially the same graph as is shown FIG. 7 would be obtained when the agitating Reynolds number is smaller than about 1,000 even if there is a difference in the area and the number of stages of the inclined blades 3, the revolutions per minute of the mixer blade assembly 1, the viscosity of liquid within the mixing vessel 5, and the liquid level.

Figure 8:
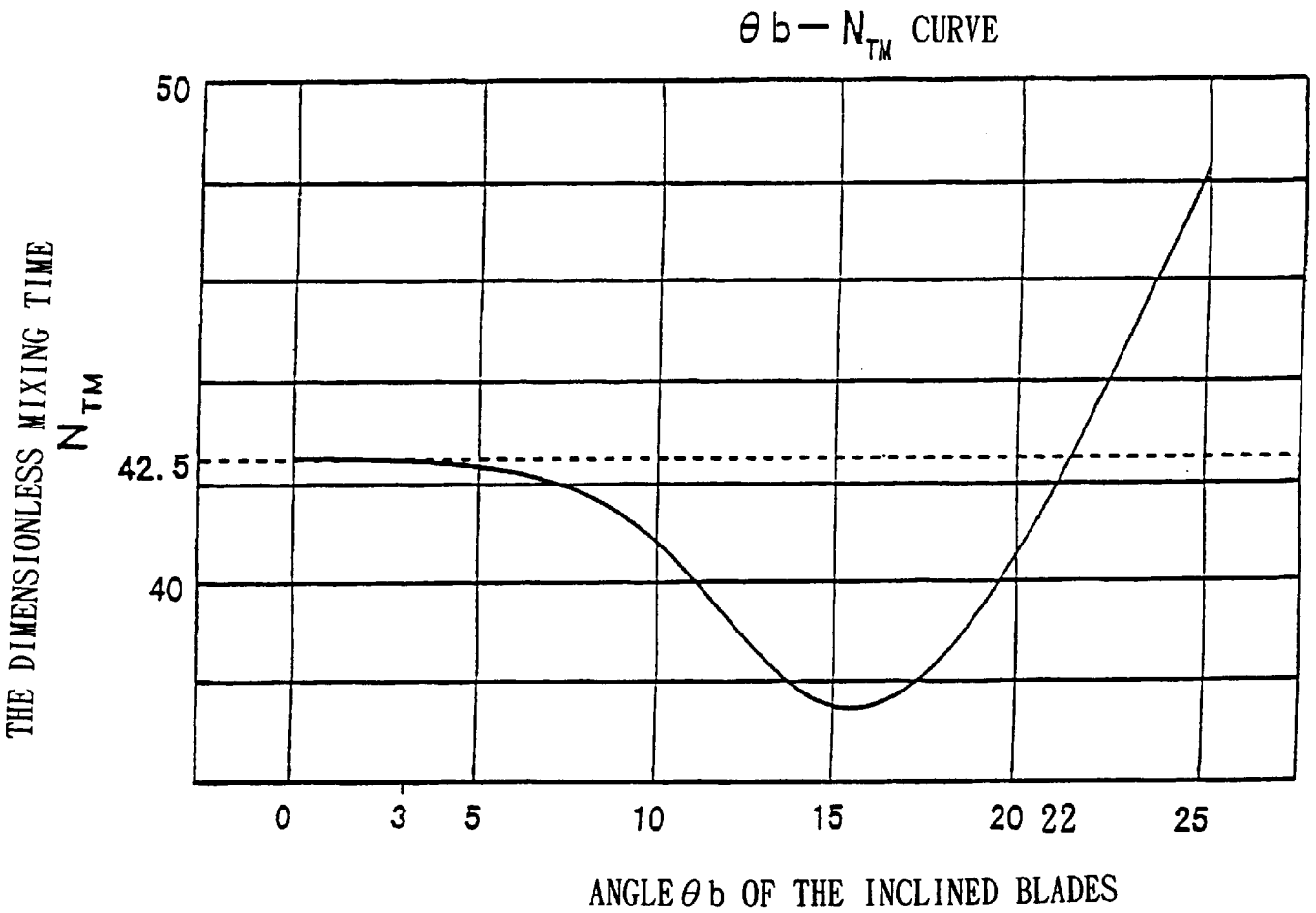
FIG. 8 is a graph showing the relationship between the dimensionless mixing time value $N_{TM}$ and the angle of advance $\theta_b$ of the inclined blades.

The graph of FIG. 8 showing a relation between the angle of advance $\theta_b$ or the row of blades and the dimensionless mixing time value $N_{TM}$ was obtained after having carried out the experiment under the same conditions as indicated above wherein the mixer blade assemblies 1 each has a different angle of advance $\theta_b$ (the inclination angle $\theta_a$ being constant).

As can be seen from the graph of FIG. 8, a region exceeding the dimensionless mixing time value $N_{TM}$ of 42.5 is not preferable from the relation between $\theta_a$–$N_{TM}$ of FIG. 7. Accordingly, the range of $\theta_a$ of 3° through 22° below an $N_{TM}$ value of 42.5 is preferable. In particular, the dimensionless mixing time value $N_{TM}$ became minimum at a region near 15° for $\theta_b$ and an excellent result was obtained at this region.

Figure 9:
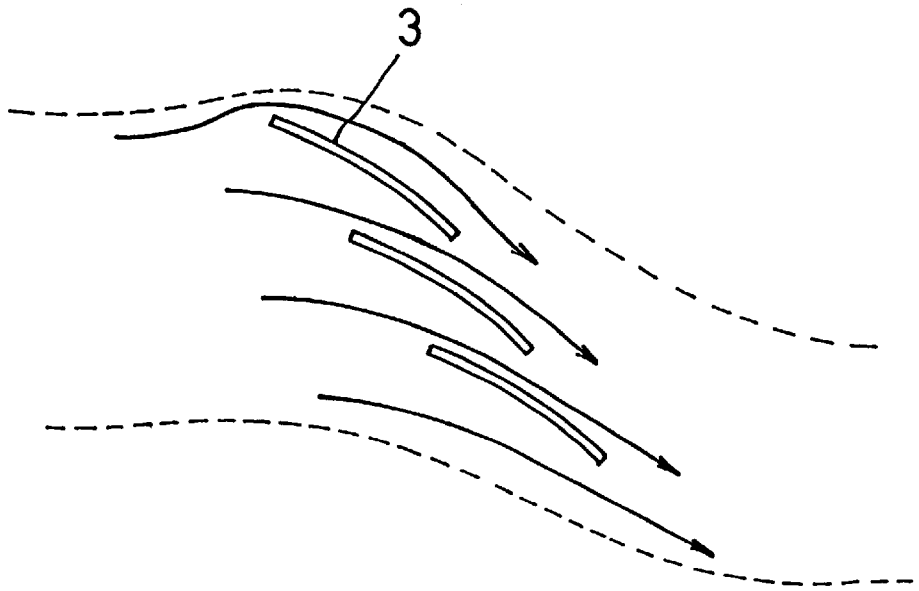
FIG. 9 is an explanatory view showing a flow condition between inclined blades each having a curved configuration.
Figure 10:
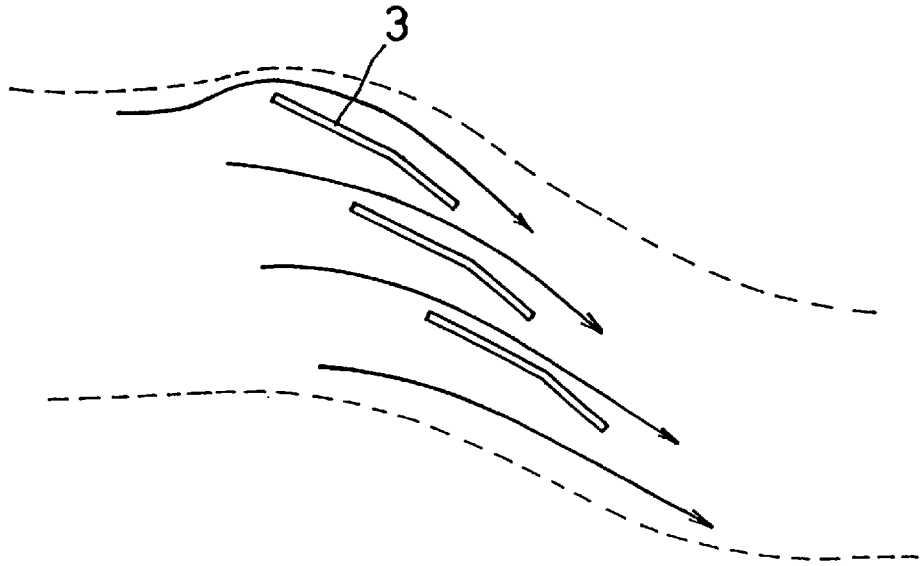
FIG. 10 is an explanatory view showing a flow condition between inclined blades each having a folded configuration.

Substantially the same graph as shown in FIG. 8 can be obtained at any angle of $\theta_a$ between 18° through 48° except for 40°. Although two posts 2 are used in the illustrated example, it is possible to use a greater number of posts. Also, although the blades 3 in the illustrated example are flat plates, it is possible to use blades having another configuration such as a curved cross-section as shown in FIG. 9 or a folded cross-section as shown in FIG. 10.

Moreover, although the inclination angle $\theta_a$ is defined as being 18° through 48° inclined upwardly as viewed from the axis of blade rotation A, it is possible to select the inclination angle $\theta_a$ as having the same range inclined downwardly as viewed from the axis of blade rotation.

In addition, although the advance angle $\theta_b$ of the row of the inclined blades is in a range of 3° through 22° rearwardly as viewed along the axis of blade rotation A successively displaced from the upper stage toward the lower stage, it is possible to select the angle $\theta_b$ so as to have the same range inclined forwardly as viewed from the axis of blade rotation.

Figure 11:
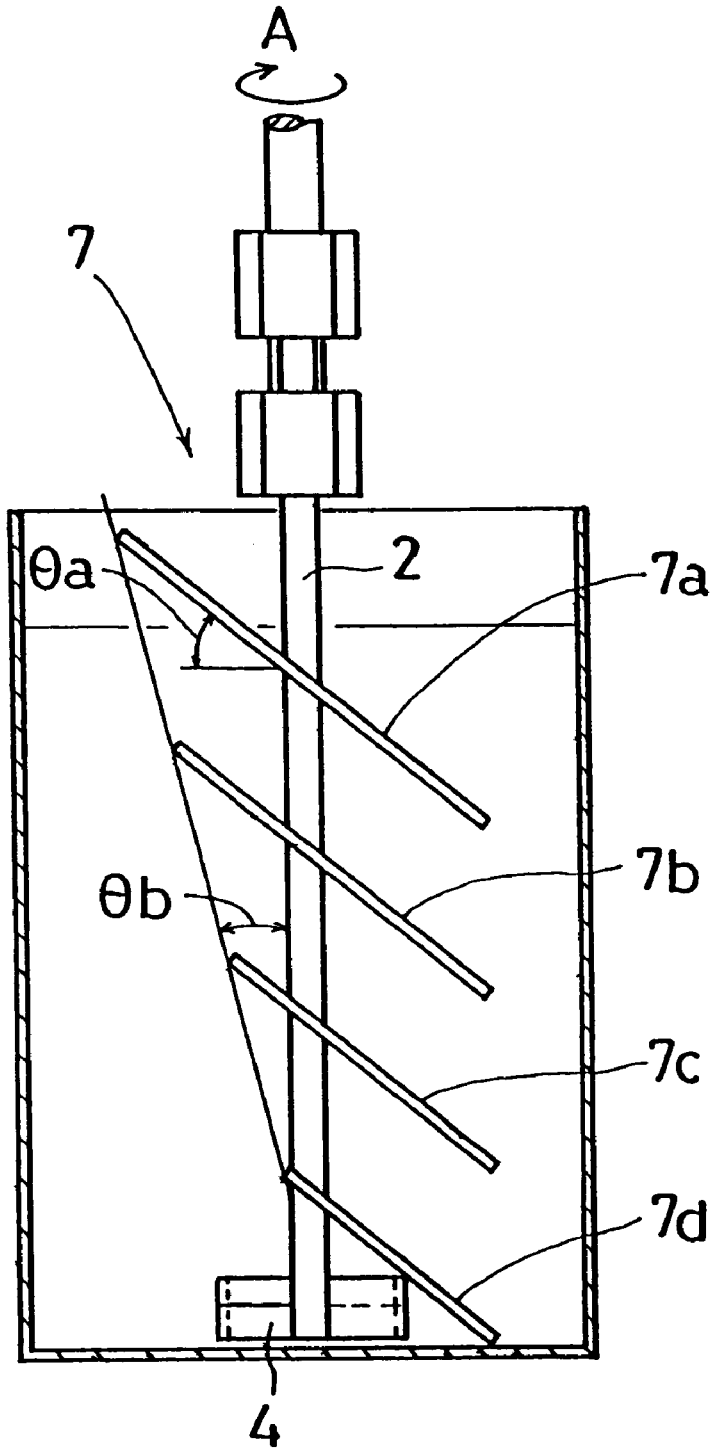
FIG. 11 is a front elevational view of a mixer blade assembly of a second embodiment of the present invention.

A second embodiment of the mixer blade assembly of the present invention will now be described with reference to FIG. 11. In the mixer blade assembly 7 of the second embodiment, the length of blades 7*a*, 7*b*, . . . 7*d* is decreased successively from the upper stage toward the lower stage, instead of the blades 3 all having the same length in the mixer blade assembly 1 of the first embodiment. The leading edges of the blades 7*a*, 7*b*, . . . 7*d* are arranged rearwardly as viewed from the blade rotation A successively displaced from the upper stage toward the lower stage. However, the trailing edges of these blades are not displaced at all and the trailing edges of the blades are in vertical alignment with one another as seen in FIG. 11.

The inclination angle $\theta_a$ and the angle of advance $\theta_b$ are same as those in the mixer blade assembly 1 of the first embodiment.

The structure of the posts 2 and the bottom impeller 4 are also same as those in the mixer blade assembly 1 of the first embodiment. The mixer blade assembly 7 in the second embodiment can achieve an excellent mixing performance without causing the generation of insufficiently mixed region of a doughnut-shaped configuration.

Figure 12:
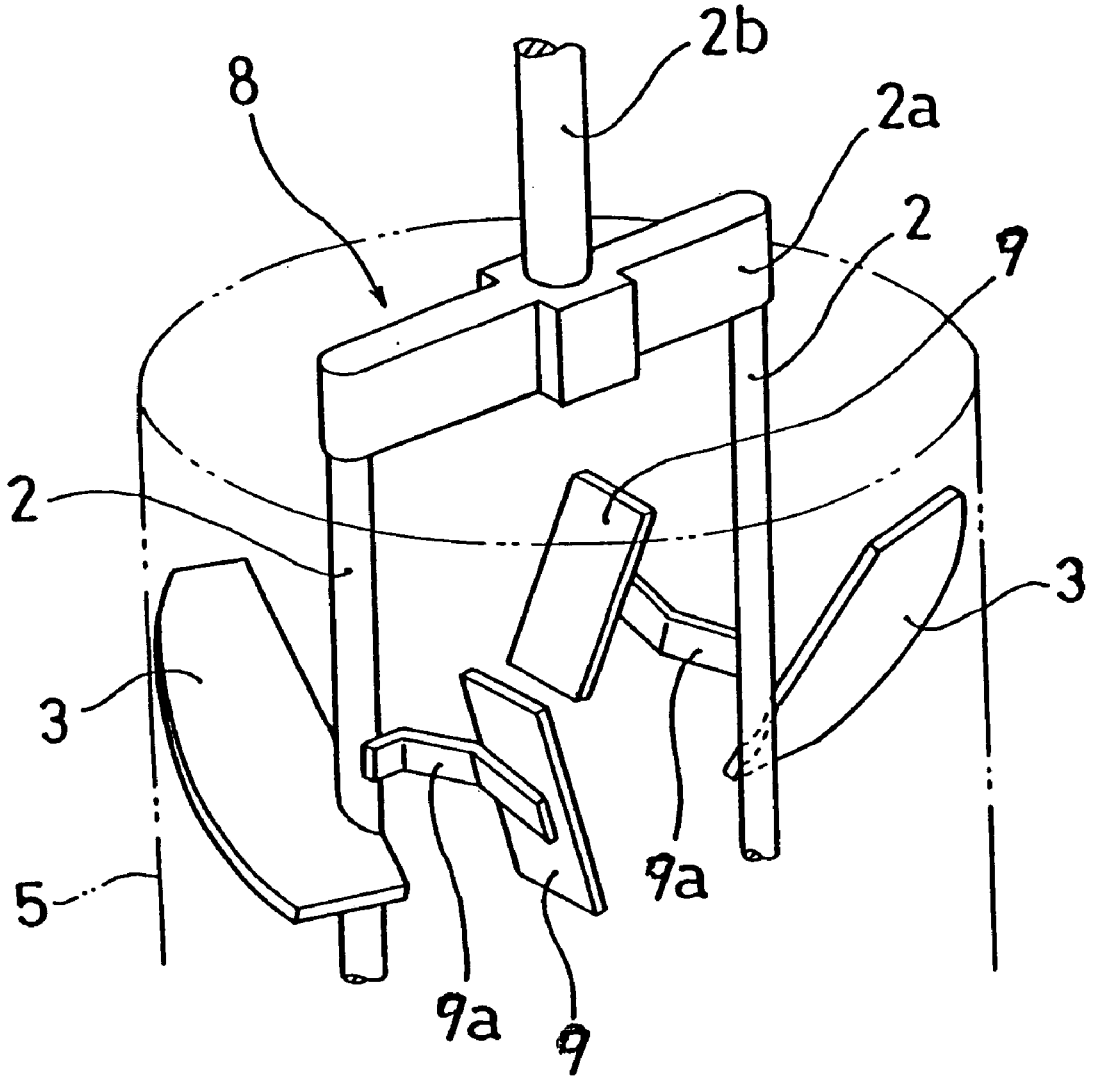
FIG. 12 is a perspective view showing an upper portion of a mixer blade assembly of a third embodiment.

A third embodiment of the mixer blade assembly of the present invention will now be described with reference to FIG. 12. The mixer blade assembly 8 of the third embodiment is the same as that of the first embodiment except for the provision of auxiliary blades 9 in the third embodiment. That is, the mixer blade assembly 8 is formed by securing one pair of auxiliary blades 9 of a single stage to the posts 2 via brackets 9*a* radially inside from the posts 2 at a position above the uppermost inclined blades 3. The mixer blade assembly 8 provided with the auxiliary blades 9 can achieve a better mixing performance than the mixer blade assembly 1 of the first embodiment when mixing liquid having a region of Reynolds number of $10^2$ through $10^3$.

Figure 13:
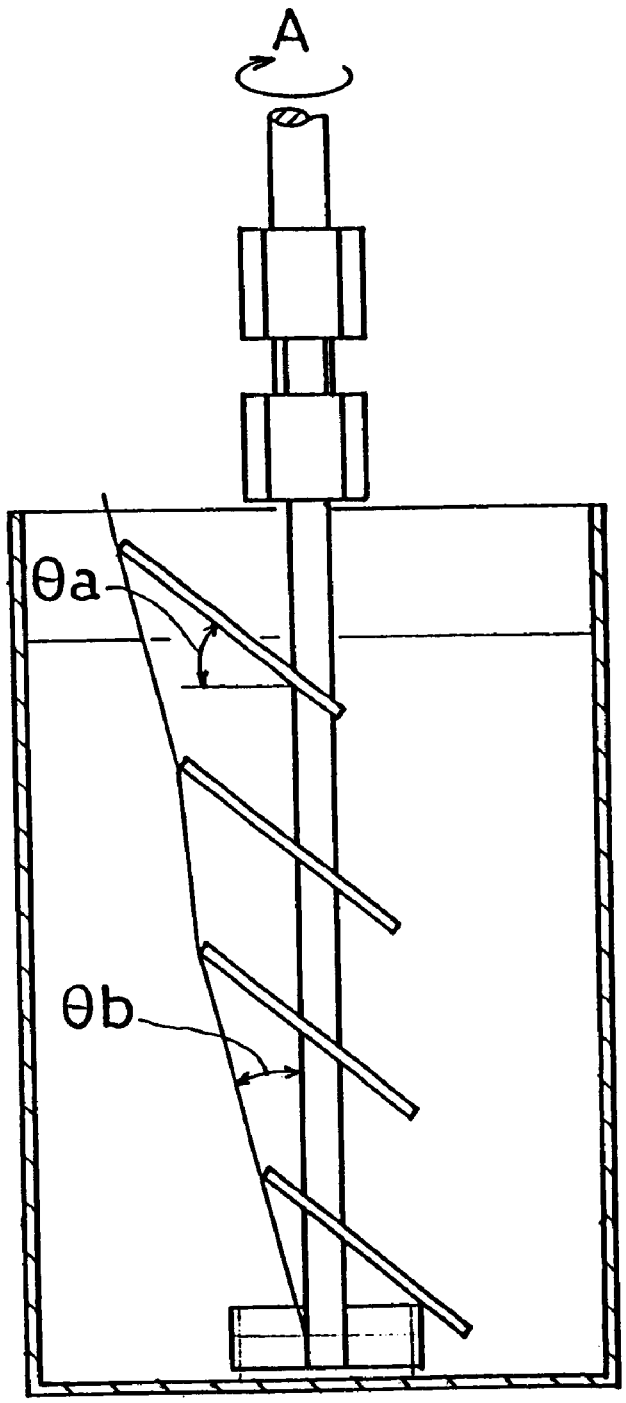
FIG. 13 is a front elevational view showing a modified example having a varying angle of advance in the mixer blade assembly of FIG. 1; and, FIG. 14 is a schematic view of a mixer blade assembly of the prior art for medium and high viscosity liquids.
Figure 14:
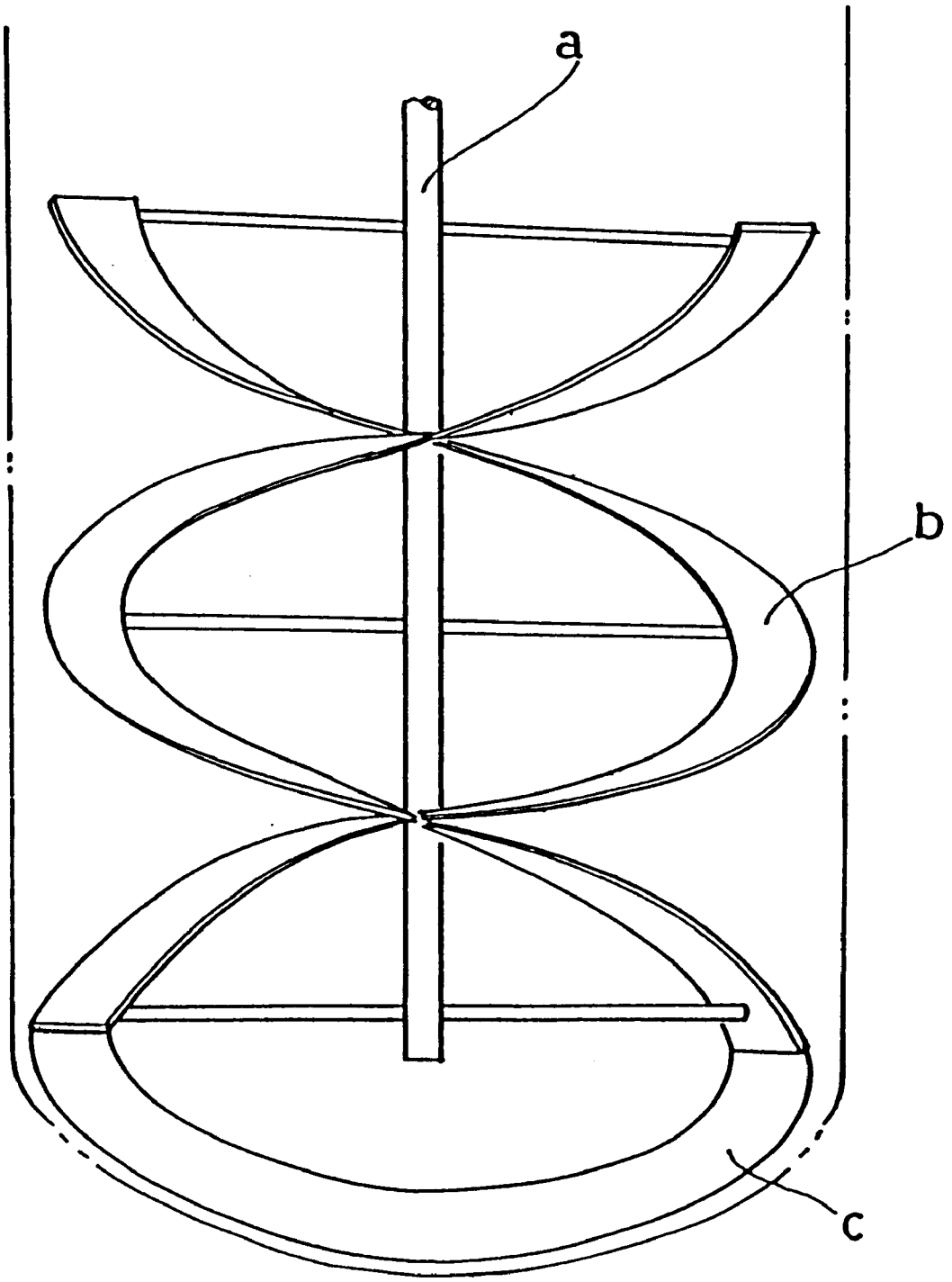
FIG.14 PRIOR ART

Although it has been described in the first through third embodiments that the all the inclined blades 3 and 7*a*, 7*b*, . . . 7*d* are displaced rearwardly as viewed from the axis of blade rotation at a constant angle of advance $\theta_b$, it is possible to vary the angle of advance in the middle of the blade row as shown in FIG. 13. Also in the second and third embodiments, it is possible to use blades having the curved configuration (FIG. 9) or the folded configuration (FIG. 10).

When the mixer blade assemblies illustrated in the drawings are rotated in a direction reverse to the illustrated axis of blade rotation A, the liquid will be forced upwardly at the periphery of the mixing vessel 5 and downwardly at the center of the mixing vessel 5. Although the direction of this circulation flow of the liquid is opposite that achieved when the mixer blade assemblies are rotated in blade direction A, the same mixing performance can be achieved. In this reverse circulation flow, the bottom impeller will act to force the liquid from the center to the periphery of the mixing vessel 5.

What is claimed is:

1. A mixer blade assembly for medium and high viscosity liquids, comprising:

a rotary shaft including at least two support posts spaced apart from each other and being positionable in a vessel, said shaft being positioned exclusively outside the vessel;

a plurality of plate-shaped inclined blades secured on each support post and spaced apart from each other so as to form multiple stages, each leading edge of said blades being displaced successively rearwardly or successively forwardly as at an angle of from 3–22° as viewed from an axis of blade rotation from an upper stage toward a lower stage so as to form a downwardly oblique liquid flow, said blades being exclusively positioned between said posts and an inner wall portion of said vessel; and a bottom impeller secured on each of the support posts in proximity with a bottom surface portion of the mixing vessel so as to generate an upward liquid flow and promote mixing of the liquid, said two support posts being positioned in said vessel so as to form an unobstructed volume in the vessel between said support posts, said blades being displaced at said angle of advance to increase an area of each of the blades acting on the liquid and thereby cause a rectifying effect on the liquid in an upper stage of the blades and a dragging effect on the liquid in a lower stage of the blades to thereby improve mixing of the liquid.

2. A mixer blade assembly for medium and high viscosity liquid as claimed in claim 1 wherein a blade of the upper stage and a blade of the lower stage adjacent to the upper stage partially overlap each other as viewed in a vertical direction.

3. A mixer blade assembly for medium and high viscosity liquid as claimed in claim 1 wherein each blade is secured on one of the support posts so that an inner edge thereof intersects said one of said support posts at a predetermined angle and wherein an outer edge thereof contacts an inner surface of the mixing vessel.

4. A mixer blade assembly for medium and high viscosity liquid as claimed in claim 3 wherein an angle of inclination of the inclined blades is in a range of 18° through 48°.

5. A mixer blade assembly for medium and high viscosity liquid as claimed in claim 1 wherein said bottom impeller is secured on each of said support posts at opposite ends thereof; the side regions of the bottom impeller in proximity with the posts being vertically positioned so as to be swept back rearwardly as viewed from the axis blade rotation and a central region between the side regions has a height smaller than that of the side regions, and wherein the bottom edge of the impeller is positioned in proximity with the bottom surface of the mixing vessel.

6. A mixer blade assembly for medium and high viscosity liquid according to claim 1 wherein said plurality of blades form a new row of blades and at least the uppermost blades of the row of blades are positioned so as to project from the liquid during use.

7. A mixer blade assembly for medium and high viscosity liquid according to claim 1 wherein each of said blades comprise a plate having one of a flat, curved and a folded configuration.

8. A mixer blade assembly as claimed in claim 1, wherein said bottom impeller has a pair of side regions which connect, respectively, to the lower portion of the support posts and has a central portion of a reduced height to reduce resistance to flow of the liquids in a bottom portion of the vessel.

9. A mixer blade assembly as claimed in claim 1, wherein said blades are displaced successively forwardly from the upper stage to the lower stage as viewed from the axis of rotation.

10. A mixer blade assembly as claimed in claim 1, wherein said blades are displaced successively rearwardly from the upper stage to the lower stage as viewed from the axis of rotation.

11. A mixer blade assembly as claimed in claim 1, wherein a length dimension of successive blades from an upper stage to a lower stage are decreased.

12. A mixer blade assembly as claimed in claim 11, wherein trailing edges of said successive blades are in vertical alignment with one another.

13. A mixer blade assembly as claimed in claim 1, wherein trailing edges of said successive blades are in vertical alignment with one another.

14. A mixer blade assembly for medium and high viscosity liquids, comprising:

a rotary shaft including at least two support posts spaced apart from each other and being positionable in a vessel, said shaft being positioned exclusively outside the vessel;

a plurality of plate-shaped inclined blades secured on each support post and spaced apart from each other so as to form multiple stages, each leading edge of said blades being displaced successively rearwardly or successively forwardly as at an angle of from 3–22° as viewed from an axis of blade rotation from an upper stage toward a lower stage so as to form a downwardly oblique liquid flow, said blades being exclusively positioned between said posts and an inner wall portion of said vessel; and a bottom impeller secured on each of the support posts in proximity with a bottom surface portion of the mixing vessel so as to generate an upward liquid flow and promote mixing of the liquid, said blades being displaced at said angle of advance to increase an area of each of the blade acting on the liquid and to thereby cause a rectifying effect on the liquid in an upper stage of the blades and a dragging effect on the liquid in a lower stage of the blades to thereby improve mixing of the liquid, wherein a plurality of an auxiliary blades are mounted on the support posts radially inside thereof.

* * * * *